US010957502B2

(12) United States Patent
Wang

(10) Patent No.: US 10,957,502 B2
(45) Date of Patent: Mar. 23, 2021

(54) CONTROL KEY ASSEMBLY

(71) Applicant: PEGATRON CORPORATION, Taipei (TW)

(72) Inventor: Chung-Kuan Wang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/744,073

(22) Filed: Jan. 15, 2020

(65) Prior Publication Data

US 2020/0234894 A1 Jul. 23, 2020

(30) Foreign Application Priority Data

Jan. 17, 2019 (TW) ..... 108101889

(51) Int. Cl.

| | |
|---|---|
| ***H01H 23/24*** | (2006.01) |
| ***H01H 13/85*** | (2006.01) |
| *H01H 13/50* | (2006.01) |

(52) U.S. Cl.

CPC ..... *H01H 13/85* (2013.01); *H01H 13/50* (2013.01); *H01H 23/24* (2013.01); *H01H 2215/004* (2013.01)

(58) Field of Classification Search

CPC ..... H01H 9/26; H01H 13/72; H01H 25/041; H01H 13/14; H01H 2215/004; H01H 25/04; H01H 3/02; H01H 3/12; H01H 13/20; H01H 23/145; H01H 23/30; H01H 2300/01; H01H 23/003; H01H 2221/018; H01H 23/143; H01H 23/14; H01H 23/00; H01H 3/50; H01H 13/70; H01H 13/64; H01H 11/0018; H01H 13/705; H01H 3/122; H01H 13/50

See application file for complete search history.

(56) References Cited

U.S. PATENT DOCUMENTS

2005/0068298 A1* 3/2005 Ho ..... G06F 3/016 345/164

FOREIGN PATENT DOCUMENTS

| | | |
|---|---|---|
| CN | 106935422 | 7/2017 |
| JP | S58159132 | 10/1983 |
| JP | 2002313188 | 10/2002 |
| JP | 2004171851 | 6/2004 |
| JP | 2009276879 | 11/2009 |
| TW | 201826309 | 7/2018 |

* cited by examiner

*Primary Examiner* — Ahmed M Saeed
(74) *Attorney, Agent, or Firm* — J.C. Patents

(57) ABSTRACT

A control key assembly including a button cover and a weight member is provided. The button cover has a first top surface, a bottom surface and a first assembling structure, wherein the first assembling structure is located on the bottom surface. The weight member has an arc surface and a second assembling structure, the arc surface and the second assembling structure are located on opposite sides of the weight member, wherein the second assembling structure is assembled with the first assembling structure, and the weight of the weight member is greater than the weight of the button cover.

4 Claims, 5 Drawing Sheets

CONTROL KEY ASSEMBLY

CROSS-REFERENCE TO RELATED APPLICATION

This application claims the priority benefit of Taiwan application serial no. 108101889, filed on Jan. 17, 2019. The entirety of the above-mentioned patent application is hereby incorporated by reference herein and made a part of this specification.

BACKGROUND

Technical Field

The disclosure relates to a control key assembly.

Description of Related Art

A conventional handheld electronic amusement device that uses a control key assembly with a direction designation key to specify the direction of movement of a character, such as an object, a person or a word in the game.

At present, the control button device on the market may use the sheet metal shrapnel the rubber button to generate a feedback after pressing.

SUMMARY

The disclosure provides a control key assembly for upgrading the feedback after pressing.

A control key assembly of the present disclosure including a button cover and a weight member is provided. The button cover has a first top surface, a bottom surface and a first assembling structure, wherein the first assembling structure is located on the bottom surface. The weight member has an arc surface and a second assembling structure, the arc surface and the second assembling structure are located on opposite sides of the weight member, wherein the second assembling structure is assembled to the first assembling structure, and the weight of the weight member is greater than the weight of the button cover.

In an embodiment of the disclosure, the control key assembly further includes a circuit board disposed toward the bottom surface of the button cover, wherein the weight member is located between the button cover and the circuit board, and the arc surface contacts the circuit board.

In an embodiment of the disclosure, the button cover further has a plurality of stickers disposed on the bottom surface and surrounding the first assembling structure. Further, the circuit board has a plurality of dome switches, and the stickers are disposed corresponding to the dome switches.

In an embodiment of the disclosure, one of the first assembling structure and the second assembling structure is a groove, and the other one of the first assembling structure and the second assembling structure is a stud, and the stud and the groove are fitted to each other.

In an embodiment of the disclosure, a virtual ball may be formed by the weight member, the virtual ball has a virtual diameter, and the button cover has the first top surface, the weight member has a second top surface, the second assembling structure is disposed on the second top surface, and a diameter of the second top surface is smaller than the virtual diameter.

Based on the above, in the control key assembly of the present disclosure, since the weight of the weight member is greater than the weight of the button cover, after the user stops applying the force on the button cover, the weight member, which deviates from balance, is driven to return to an original steady state based on the principle of stable. Therefore, the button cover automatically returns to the steady state for balance raise the feedback after pressing.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
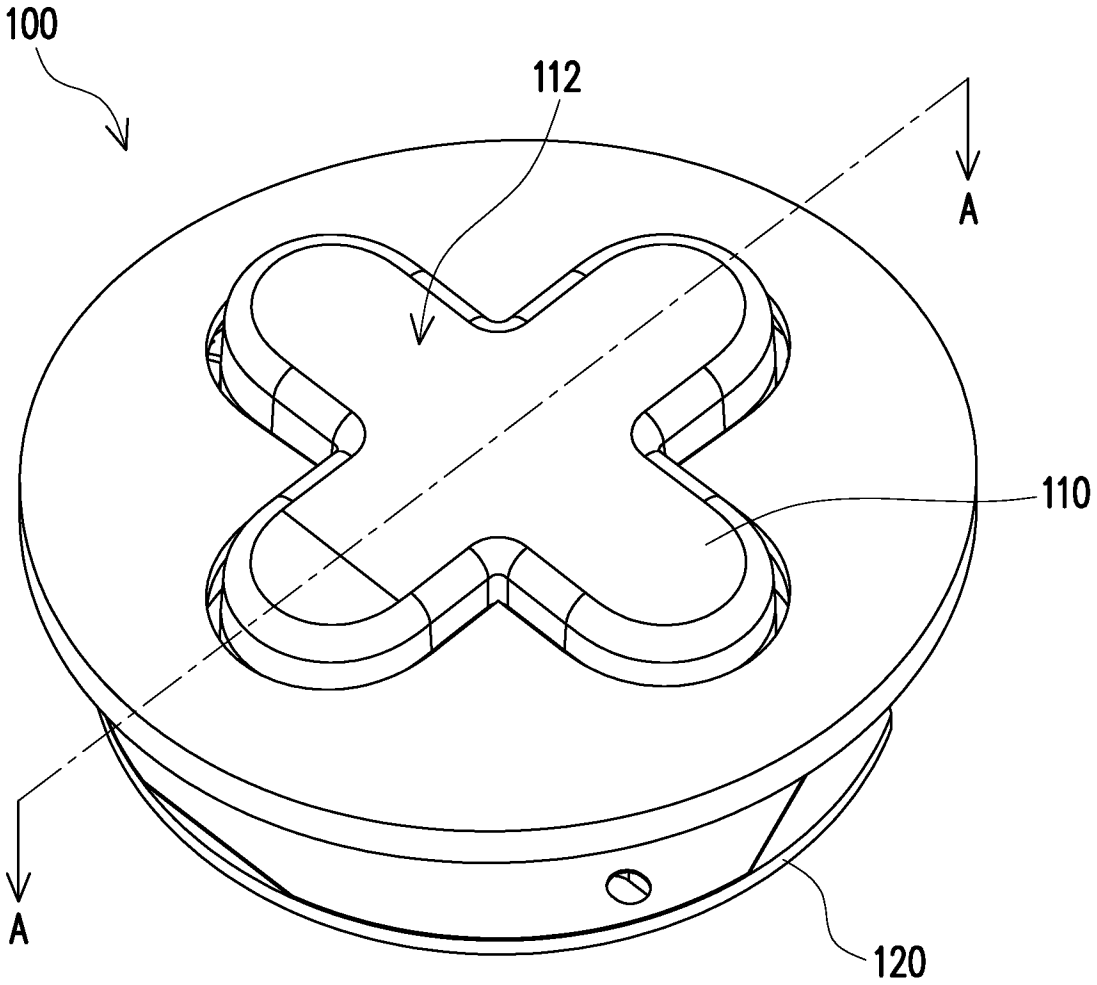
FIG. 1 is a schematic view illustrating a control key assembly of the present invention.
Figure 2:
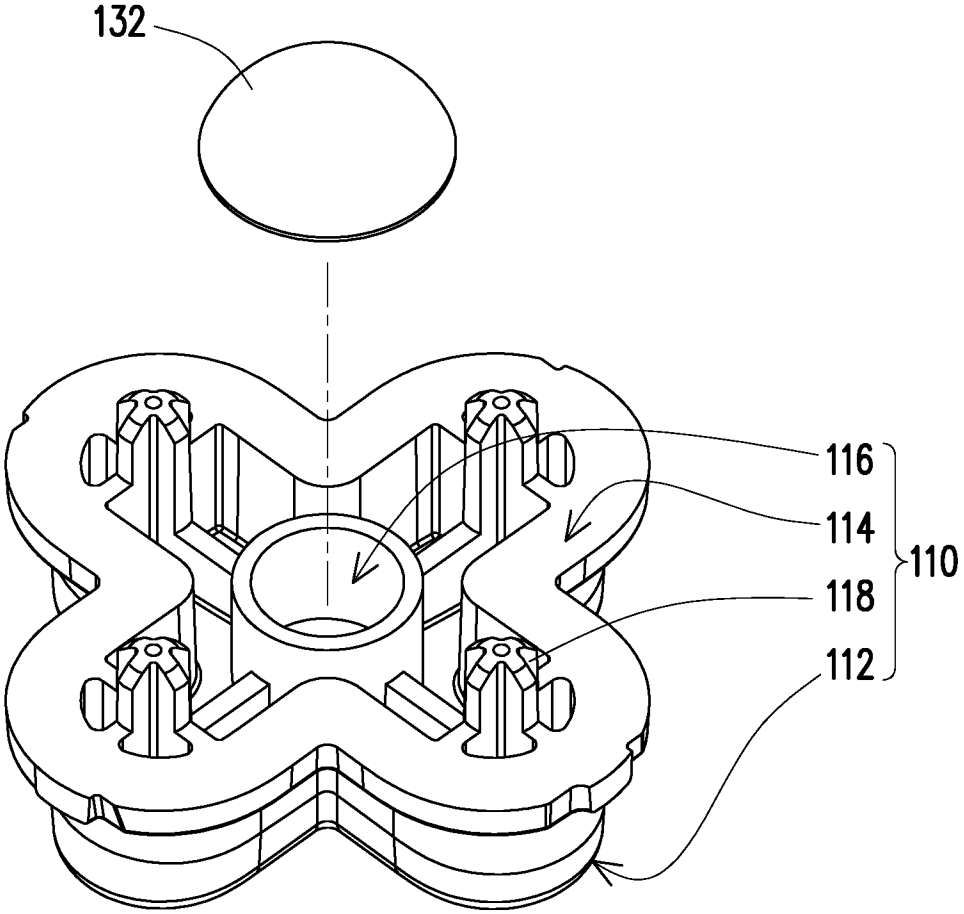
FIG. 2 is a schematic view illustrating the dismantling of the button cover and the weight member of the control key assembly of FIG.1.
Figure 3:
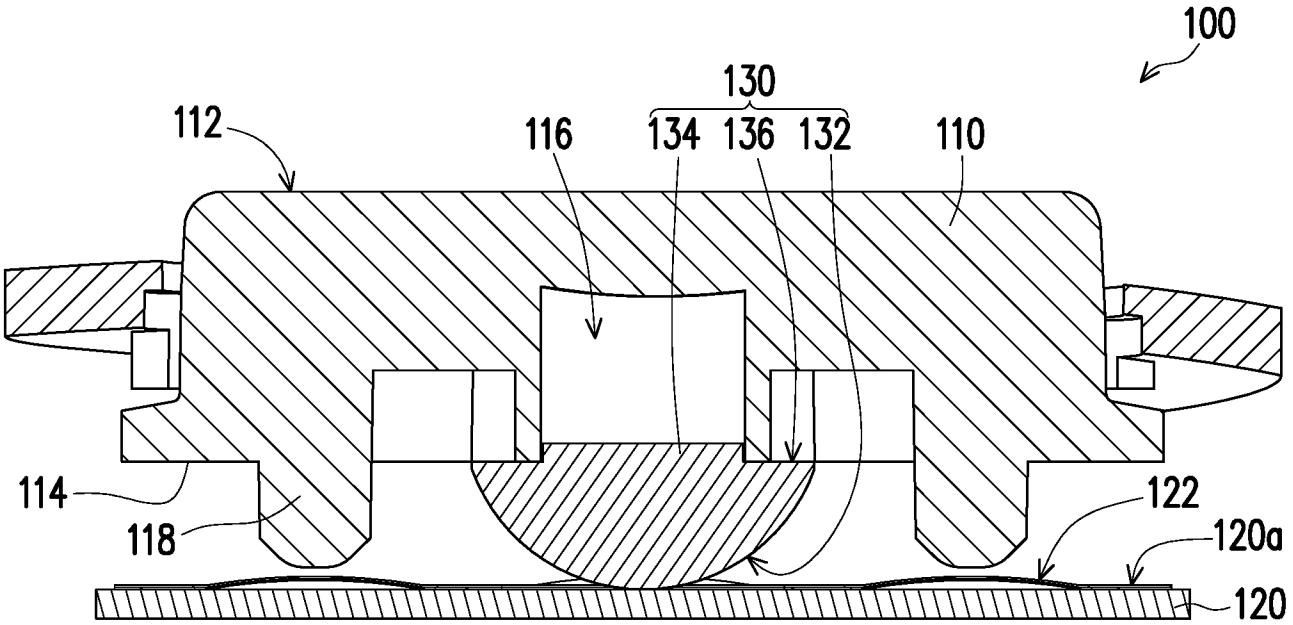
FIG. 3 is a schematic view illustrating the control key assembly along the line A-A in FIG. 1.

FIG. 1 is a schematic view illustrating a control key assembly of the present invention;

FIG. 2 is a schematic view illustrating the dismantling of the button cover and the weight member of the control key assembly of FIG.1, wherein FIG. 2 and FIG. 1 are different views for illustrating details with a side cover of the cover is omitted; and FIG. 3 is a schematic view illustrating the control key assembly along the line A-A in FIG. 1.

Referring to FIG. 1, FIG. 2 and FIG. 3 simultaneously, the control key assembly 100 of the embodiment includes a button cover 110, a circuit board 120, and a weight member 130. The button cover 110 has a first top surface 112, a bottom surface 114, and a first assembling structure 116, wherein the first top surface 112 and the bottom surface 114 are located on opposite sides of the button cover 110, and the first assembling structure 116 is located on the bottom surface 114. The circuit board 120 is disposed toward the bottom surface 114 of the button cover 110. The weight member 130 is located between the button cover 110 and the circuit board 120. The weight member 130 has an arc surface 132 and a second assembling structure 134. The arc surface 132 and the second assembling structure 134 are located on opposite sides of the weight member 130. The second assembling structure 134 is used to be assembled to the first assembling structure 116, and the weight of the weight member 130 is greater than the weight of the button cover 110.

In this embodiment, the material of the weight member 130 may be metal, and the material of the button cover 110 may be plastic. The button cover 110 is further formed to have a hollow cavity for emphasizing the weight difference between the weight member 130, so as to achieve the purpose that maintaining the control key assembly 100 to be in a steady state by balancing the weight member 130.

Moreover, the button cover 110 in the present embodiment is in the form of a cross key, which can be used to guide the moving direction of a specified person or character; however, the form of the button cover 110 is not limited thereto, and the button cover 110 can also be in a linear shape or be a round key, which designed according to actual requirements.

The weight member 130 has a second top surface 136, and the second assembling structure 134 is disposed on the second top surface 136. In the present embodiment, the first assembling structure 116 is a groove; or, more specifically, the first assembling structure 116 is a hollow cylinder, and the second assembling structure 134 is a stud, which is conformal to the first assembling structure 116, and the stud is used to fit into the groove.

In addition, the button cover 110 further has a plurality of stickers 118 disposed on the bottom surface 114 and surrounding the first assembling structure 116. Since the button cover 110 in this embodiment is in the form of a cross key, the stickers 118 may set to four. Correspondingly, the circuit board 120 is provided with four dome switches 122, and the positions of the stickers 118 are corresponding to the positions of the dome switches 122.

In the embodiment of FIG. 3, the arc surface 132 of the weight member 130 directly contacts a third top surface 120*a* of the circuit board 120. Since the arc surface 132 of the weight member 130 directly contacts the third top surface 120*a* of the circuit board 120, the center of gravity of the control key assembly 100 is lowered by the arrangement of the weight member 130. In a force balance state of the control key assembly 100, the arc surface 132 contacts the third top surface 120*a* of the board 120 in a manner of point, four stickers 118 spaced from the third top surface 120*a* of the circuit board 120 in a same distance while four stickers 118 do not contact with corresponding dome switches 122 by the arrangement of the arc surface 132 of the weight member 130.

The user presses on one of the four ends of the cross key for using the control key assembly 100 to direct the direction of movement of a specified person or character.

Figure 4:
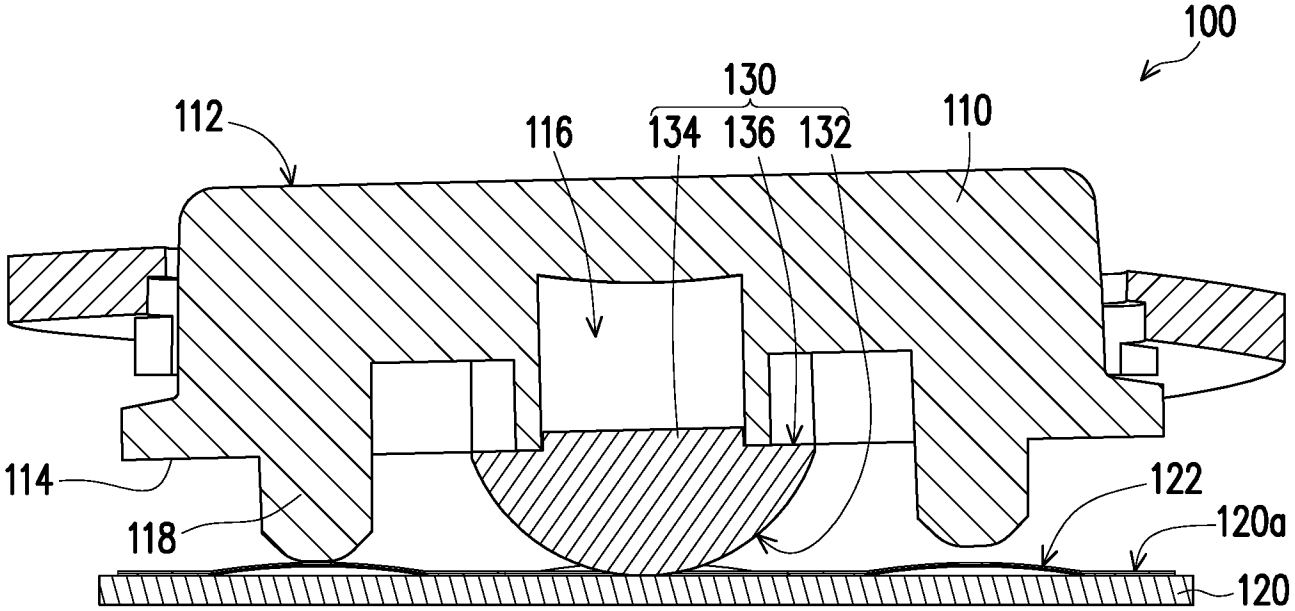
FIG. 4 is a schematic view illustrating a user pressing the button cover.

FIG. 4 is a schematic view illustrating the user pressing the button cover. Referring to FIG. 4, as the user applying force on the button cover 110, the button cover 110 takes the contact point of the arc surface 132 of the weight member 130 and the third top surface 120*a* of the circuit board 120 as a center of rotation, and the end that is pressed orienting towards the circuit board 120 and is inclined downward, and the other unpressurized ends are inclined upward in a direction away from the circuit board 120, and the sticker 118 corresponding to the pressed end presses the dome switch 122 to conduct electricity and emits telecommunications to guide the direction of movement of a specified person or character.

Figure 5:
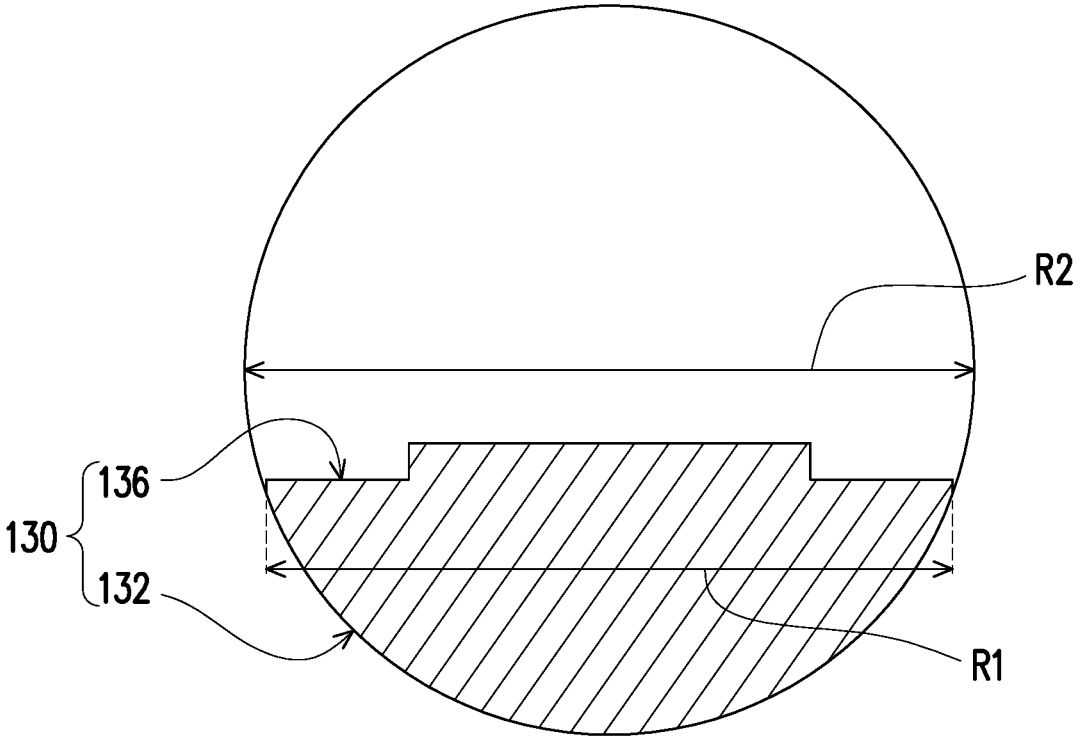
FIG. 5 is a schematic view illustrating a virtual circle formed by the weight member.

In particular, the weight member 130 in this embodiment is not a semi-spherical ball. In detail, when a virtual ball having a complete circular shape is formed on the basis of the arc surface 132 of the weight member 130, the diameter R1 of the second top surface 136 is smaller than the virtual diameter R2 of the virtual ball, as shown in FIG. 5. By designing the weight member 130 in a form other than a semi-spherical ball, the center of gravity of the weight member 130 is maintained at a relatively low position of the weight member 130.

Therefore, after the user stops applying pressure, since the center of gravity of the control key assembly 100 falls at a lower position and the weight 130 contacts the third top surface 120*a* of the circuit board 120 by the arc surface 132, the weight member 130 drives the button cover 110 to return to the original position with self-adjusting of the weight member 130 to the force balance state.

In summary, in the control key assembly of the present invention, the center of gravity of the control key assembly is lowered by the arrangement of the weight member, so that after the control key assembly is disturbed by an external force and deviates from the equilibrium position, the button cover is driven by the weight through the arc surface of the weight member for returning to the original position in a stable balance manner, and raising feedback after the pressing by the stable balance recovery.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A control key assembly comprising:

a button cover having a first top surface, a bottom surface, and a first assembling structure, wherein the first assembling structure is located on the bottom surface; and a weight member having an arc surface and a second assembling structure, the arc surface and the second assembling structure being located on opposite sides of the weight member, wherein the second assembly is assembled to the first assembling structure, and the weight of the weight member is greater than the weight of the button cover, wherein a virtual ball is formed by the weight member, the virtual ball having a virtual diameter, and the button cover has the first top surface, the weight member has a second top surface, the second assembling structure is disposed on the second top surface, and a diameter of the second top surface is smaller than the virtual diameter; wherein the button cover further has a plurality of sticks disposed on the bottom surface and surrounding the first assembling structure.

2. The control key assembly of claim 1, further comprising a circuit board disposed toward the bottom surface of the button cover, wherein the weight member is located between the button cover and the circuit board, and the arc surface contacts the circuit board.

3. The control key assembly of claim 1, wherein the circuit board has a plurality of dome switches, and the sticks are disposed corresponding to the dome switches.

4. The control key assembly of claim 1, wherein one of the first assembling structure and the second assembling structure is a groove, and the other one of the first assembling structure and the second assembling structure is a stud, and the stud and the groove are fitted to each other.

* * * * *